US009514637B2

(12) United States Patent
Baker et al.

(10) Patent No.: US 9,514,637 B2
(45) Date of Patent: Dec. 6, 2016

(54) WIRELESS TWO-WAY COMMUNICATION PROTOCOL FOR AUTOMATED FURNITURE ACCESSORY INTEGRATION

(71) Applicant: L & P Property Management Company, South Gate, CA (US)

(72) Inventors: Chad Baker, Georgetown, KY (US); Ryan Edward Chacon, Carthage, MO (US); Dave Jones, St. Charles, MO (US); William Rohr, Joplin, MO (US); Vinod Kumar Gopalakrishnan, Carthage, MO (US); David M. Linhoff, St. Peters, MO (US)

(73) Assignee: L & P Property Management Company, South Gate, CA (US)

( * ) Notice: Subject to any disclaimer, the term of this patent is extended or adjusted under 35 U.S.C. 154(b) by 133 days.

(21) Appl. No.: 14/164,132

(22) Filed: Jan. 24, 2014

(65) Prior Publication Data

US 2014/0203921 A1 Jul. 24, 2014

Related U.S. Application Data

(63) Continuation-in-part of application No. 13/749,087, filed on Jan. 24, 2013.

(51) Int. Cl.
*G08C 17/02* (2006.01)
*G08C 19/00* (2006.01)
(Continued)

(52) U.S. Cl.
CPC ..... *G08C 17/02* (2013.01); *G08C 2201/93* (2013.01)

(58) Field of Classification Search
CPC ..... G08C 17/02; G08C 19/00; H04B 1/202; H04B 1/20; H04B 1/00
(Continued)

(56) References Cited

U.S. PATENT DOCUMENTS 5,086,385 A 2/1992 Launey et al.
5,109,222 A * 4/1992 Welty ..... G08B 25/008 340/12.28
(Continued)

FOREIGN PATENT DOCUMENTS

EP 2549684 A4 7/2014

OTHER PUBLICATIONS

PCT Appl. No. PCT/US2013/077557, Search Report dated May 6, 2014; 38 pages.
(Continued)

*Primary Examiner* — Nam V Nguyen
(74) *Attorney, Agent, or Firm* — Shook, Hardy & Bacon, LLP

(57) ABSTRACT

A system and method for integrating furniture accessories and generic devices with automated furniture items is provided. In embodiments, a communication protocol enables a remote device to wirelessly control a generic device wirelessly coupled to a control component of an automated furniture item. The remote device may control features of the generic device based on wireless communication with the control component. In some embodiments, the remote device receives a user environment selection, which is communicated to the control component of the automated furniture item. The automated furniture item then communicates at least a portion of the received command to a corresponding generic device, according to the settings of the selected user environment. In further embodiments, an occupancy detection indication for the automated furniture item may result in a change in one or more settings corresponding to the user environment, as communicated to the generic device(s) by the control component.

20 Claims, 6 Drawing Sheets

(51) Int. Cl.
*H04B 1/00* (2006.01)
*G05B 19/18* (2006.01)
*G05D 1/00* (2006.01)

(58) Field of Classification Search
USPC ..... 340/12.5, 573.1, 500, 539.1, 5.1, 5.5,340/5.61; 700/17, 9, 19; 455/3.03; 701/2, 41
See application file for complete search history.

(56) References Cited

U.S. PATENT DOCUMENTS 5,602,664 A * 2/1997 Doyle ..... H04B 10/29 340/12.11
5,636,211 A 6/1997 Newlin et al.
5,782,036 A 7/1998 Bertieri et al.
5,963,624 A * 10/1999 Pope ..... H04M 11/007 348/734
6,169,879 B1 1/2001 Perlman
6,256,739 B1 7/2001 Skopp et al.
6,285,912 B1 9/2001 Ellison et al.
6,469,633 B1 * 10/2002 Wachter ..... G08C 17/02 340/12.5
6,542,076 B1 4/2003 Joao
6,748,278 B1 * 6/2004 Maymudes ..... G05B 15/02 340/12.3
6,870,477 B2 * 3/2005 Gruteser ..... A47C 15/004 340/3.1
6,964,370 B1 11/2005 Hagale et al.
6,998,955 B2 * 2/2006 Ballew ..... G08C 17/02 340/5.1
7,006,006 B2 * 2/2006 Witkow ..... G08C 17/00 340/12.3
7,009,522 B2 * 3/2006 Flanagan ..... B60R 99/00 177/136
7,044,619 B2 * 5/2006 Sanderlin ..... F16M 13/00 248/127
7,135,958 B1 11/2006 Suuronen et al.
7,136,913 B2 * 11/2006 Linderman ..... G06F 17/30607 709/201
7,151,968 B2 12/2006 Williamson
7,171,708 B2 2/2007 Osborne et al.
7,349,772 B2 3/2008 Delaney et al.
7,379,778 B2 5/2008 Hayes et al.
7,583,197 B2 9/2009 Wesby Van Swaay
7,680,878 B2 3/2010 Tsuchida et al.
7,768,420 B2 8/2010 Neogi et al.
7,812,739 B2 10/2010 Chuey
8,310,348 B2 11/2012 Fang
8,634,720 B2 * 1/2014 Petricoin, Jr. ..... G08C 17/00 398/126
8,713,301 B2 4/2014 Fredriksson
8,816,845 B2 * 8/2014 Hoover ..... B60N 2/002 340/539.11
8,926,535 B2 1/2015 Rawls-Meehan
2004/0036624 A1 2/2004 Ballew et al.
2004/0203387 A1 10/2004 Grannan
2008/0077020 A1 * 3/2008 Young ..... A61B 5/0205 600/484
2008/0262657 A1 10/2008 Howell et al.
2009/0100599 A1 4/2009 Rawls-Meehan
2010/0052576 A1 3/2010 Steiner et al.
2010/0162285 A1 * 6/2010 Cohen ..... H04H 60/31 725/12
2012/0072236 A1 3/2012 Atkin
2012/0072238 A1 3/2012 Collins, Jr. et al.
2012/0112891 A1 5/2012 Rawls-Meehan
2013/0024018 A1 1/2013 Chang et al.
2013/0174343 A1 7/2013 Chacon et al.
2013/0199420 A1 8/2013 Hjelm
2013/0247302 A1 9/2013 Chacon et al.
2014/0302795 A1 10/2014 Chacon et al.

OTHER PUBLICATIONS

Non-Final Office Action dated Sep. 25, 2014 in U.S. Appl. No. 13/749,087, 23 pages.
International Search Report with Written Opinion dated May 4, 2015 in Application No. PCT/US2015/012211, 13 pages.
Final Office Action dated May 29, 2015 in U.S. Appl. No. 13/749,087, 24 pages.
Non-Final Office Action dated Nov. 18, 2015 in U.S. Appl. No. 13/749,087, 15 pages.
International Preliminary Report on Patentability dated Aug. 6, 2015 in Application No. PCT/US2013/077557, 9 pages.
International Search Report with Written Opinion dated Sep. 8, 2015 in Application No. PCT/US2015/036227, 13 pages.

* cited by examiner

WIRELESS TWO-WAY COMMUNICATION PROTOCOL FOR AUTOMATED FURNITURE ACCESSORY INTEGRATION

CROSS-REFERENCE TO RELATED APPLICATIONS

This application is a continuation-in-part of U.S. Non-provisional patent application Ser. No. 13/749,087, filed Jan. 24, 2013, and entitled "Wireless Two-Way Communication Protocol for Automated Furniture Accessory Integration," which is hereby incorporated by reference in its entirety.

STATEMENT REGARDING FEDERALLY SPONSORED RESEARCH OR DEVELOPMENT

Not applicable.

TECHNICAL FIELD

Embodiments of the present invention generally relate to a wireless, two-way communication protocol for integrating furniture accessories and generic devices with automated furniture items. More particularly, embodiments of the present invention relate to a communication protocol for using a remote device to control automated furniture accessories and/or generic devices coupled to a control component of an automated furniture item.

BACKGROUND OF THE INVENTION

A variety of methods exist for using a controller to manipulate an automated furniture item. Such controllers direct the operation of various "standard" integrated elements for automated furniture items, such as a head motor or foot motor on an adjustable bed. However, external accessories may also be provided for use with an automated furniture item, such as a heating blanket. Unless the heating blanket is integrated into the control system of the automated furniture item, it will likely be controlled separately from the furniture item, requiring an additional device and/or remote. Further, the controller of an automated furniture item is typically equipped with the necessary firmware to operate the standard devices provided with the furniture item (i.e., those devices that the manufacturer intended to be operated by the furniture item controller).

Accordingly, a need exists for a communication protocol that enables additional, automated furniture accessories and/or external, generic wireless devices to be operated by an automated furniture controller without the need to update the firmware of the furniture item controller.

BRIEF SUMMARY OF THE INVENTION

The present invention generally relates to a system and method for integrating automated furniture accessories with automated furniture items. Embodiments of the invention include a communication protocol for using a remote device to control an automated furniture accessory coupled to a control component of an automated furniture item.

One illustrative embodiment of the invention, a system for integrating automated furniture accessories with automated furniture items includes a control component comprising: (1) a wireless communication device; (2) a CAN bus; and (3) at least one automated furniture accessory coupled to the CAN bus, wherein one or more features of the at least one automated furniture accessory are controlled by a remote device wirelessly coupled to the control component.

In another illustrative aspect, a method for integrating automated furniture accessories with automated furniture items comprises: receiving an indication of an automated furniture accessory coupled to a control component; identifying one or more packets of information associated with the automated furniture accessory; and communicating at least one of the one or more packets of information to a remote device, wherein the remote device is adapted to control one or more features of the automated furniture accessory based at least in part on communication between the remote device and the control component.

According to a third illustrative aspect, embodiments of a method for integrating automated furniture accessories with automated furniture items comprises receiving one or more items of identifying information associated with at least one automated furniture accessory coupled to a control component and communicating at least one of the one or more items of identifying information to a remote device, wherein the remote device is in wireless, two-way communication with the control component, wherein one or more features of the at least one automated furniture accessory are controlled by the remote device based on communication of the at least one of the one or more items of identifying information.

In a fourth illustrative aspect of an embodiment of the invention includes a system for integrating one or more generic devices with an automated furniture item. The system includes a first generic device having a first wireless communication device; and a control component coupled to the first generic device, the control component including a second wireless communication device. In embodiments, one or more features of the first generic device are controlled by a remote device wirelessly coupled to the control component, said remote device including a third wireless communication device.

According to a fifth illustrative aspect, an embodiment of the invention includes a method for integrating generic devices with automated furniture items. The method includes receiving, by a control component of an automated furniture item, an indication of at least one generic device wirelessly coupled to the control component, wherein the at least one generic device is external to the control component; receiving a first command from a remote device wirelessly coupled to the control component, wherein the first command corresponds to one or more features of the at least one generic device; wirelessly communicating the received first command from the control component to the at least one generic device; receiving an indication of occupancy associated with the automated furniture item; based at least in part on the received indication of occupancy, determining a second command corresponding to a feature of the at least one generic device; and wirelessly communicating the determined second command from the control component to the at least one generic device.

A sixth illustrative aspect of the invention is directed to a method for establishing a particular user environment corresponding to occupancy detection for an automated furniture item coupled to at least one generic device. The method includes: receiving an indication of a particular user environment selection from a remote device, the particular user environment selection comprising a set of commands corresponding to settings of the particular user environment for at least one generic device coupled to a control component of the automated furniture item; communicating at least one primary command corresponding to the received user environment selection from the control component to the at least one generic device wirelessly coupled to the control component; receiving an indication of a change in occupancy detection associated with the automated furniture item; determining at least one secondary command based at least in part on: (1) the set of commands for the at least one generic device; and (2) the received change in occupancy detection; and communicating the at least one secondary command to the at least one generic device coupled to the control component.

Additional objects, advantages, and novel features of the invention will be set forth in part in the description that follows, and in part will become apparent to those skilled in the art upon examination of the following, or may be learned by practice of the invention.

BRIEF DESCRIPTION OF SEVERAL VIEWS OF THE DRAWING

The present invention is described in detail below with reference to the attached drawing figures, wherein.

DETAILED DESCRIPTION OF THE INVENTION

Figure 1:
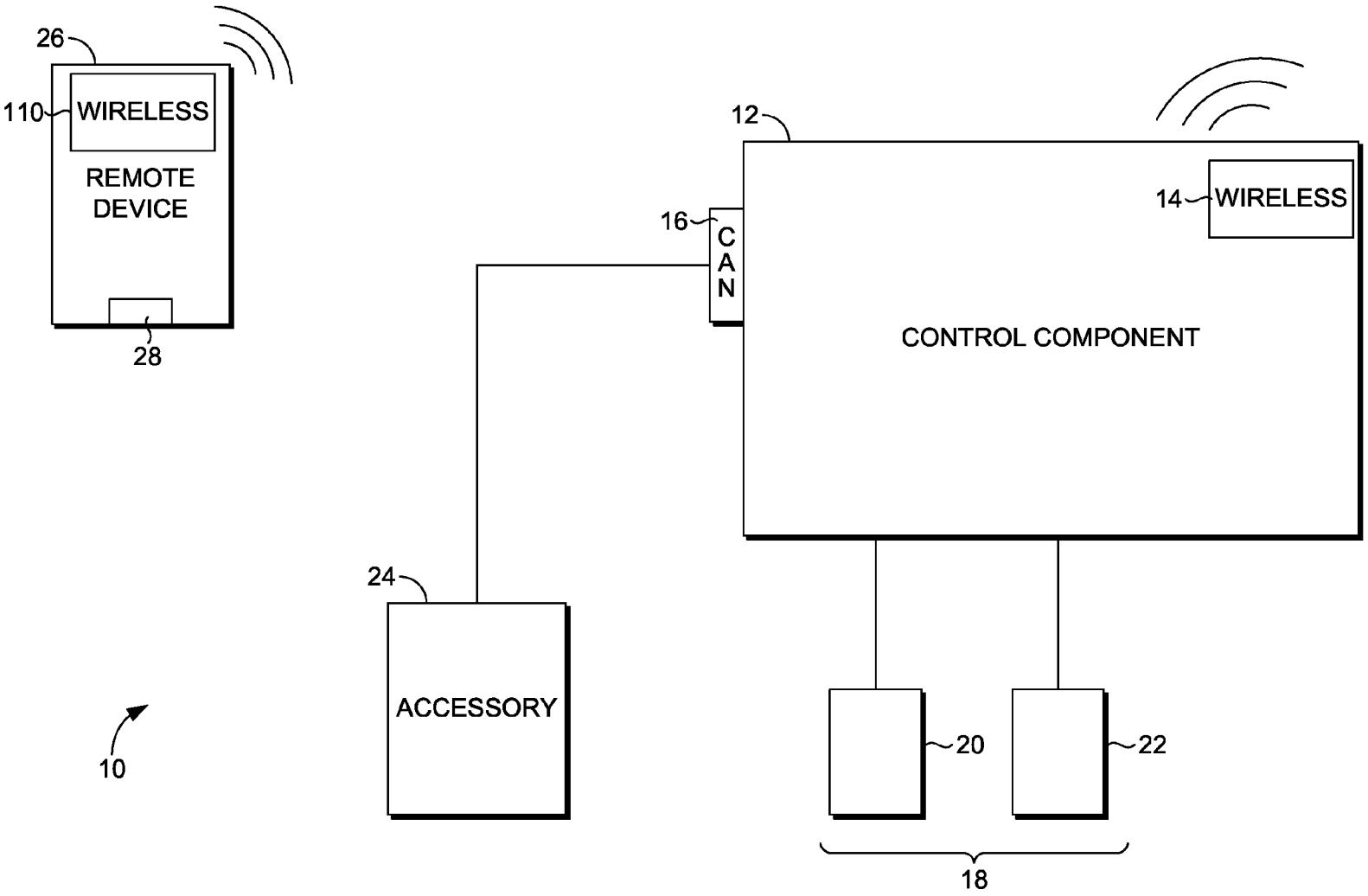
FIG. 1 is a system for integrating automated furniture accessories with automated furniture items, in accordance with an embodiment of the invention.

An embodiment of a system 10 for integrating automated furniture accessories with automated furniture items is seen in FIG. 1. In the embodiment of FIG. 1, the system 10 generally includes a control component 12 having a wireless communication device 14, a controller area network (CAN) bus 16, integrated features 18 including a head motor 20 and a foot motor 22, and an automated furniture accessory 24 coupled to the CAN bus 16 of the control component 12. Further, the control component 12 is depicted as being in wireless communication with a remote device 26 having a data port 28 and a wireless communication device 110.

In one embodiment, control component 12 controls various features of an automated furniture item that are operated based on commands received by the control component 12. For example, the control component 12 may control integrated features 18 that are integral to the operation of the automated furniture item, such as a head motor 20 that raises and lowers the head of an adjustable bed. Although exemplary integrated features 18 are shown in FIG. 1, such as the head motor 20 and the foot motor 22, it should be understood that any number or combination of integrated features 18 may be coupled to the control component 12, such as a massage motor, a programming port, a wired remote device, and the like.

In some embodiments, the control component 12 includes a processor and a memory capable of receiving and processing commands that are identifiable using the firmware of the control component 12. For example, the control component 12 may receive a command to operate one or more of the integrated features 18 coupled to the automated furniture item. Accordingly, a remote device 26 may receive an input command from a user, which the remote device 26 transmits, wirelessly, to the wireless communication device 14 of control component 12, using wireless communication device 110. The command may relate to one or more of the integrated features 18 coupled to the control component 12, such as a command to lower both the head and the foot of an automated bed (using head motor 20 and foot motor 22).

Wireless communication device 14 may be used in the transmission of wireless commands to and from the control component 12. As such, wireless communication device 14 may be any wireless communication device used to transmit wireless communication to and from one or more remote devices that communicate wirelessly with the control component 12. For example, the wireless communication device 14 may be a wireless device that executes a two-way communication protocol, such as a MiWi and/or Zigbee protocol. In further embodiments, wireless communication device 14 communicates using 2.4 GHz protocols, including 2.4 GHz side bands or 2.4 GHz stacks. Additionally, in one example, wireless communication device 14 may execute a RF4CE protocol. In some embodiments, wireless communication device 14 is used to communicate wirelessly between the control component 12 and the remote device 26, which may also be referred to as a remote control.

In addition to communicating via wireless communication device 14, the control component 12 may also interact with external devices that are coupled to the control component 12, such as the automated furniture accessory 24 coupled to the CAN bus 16 of the control component 12. In embodiments, the CAN bus 16 may directly or indirectly couple one or more automated furniture accessories 24 to the control component 12. In one example, integrated features 18 may be directly coupled to the control component 12 (e.g., distributed with the control component 12 upon manufacture of the automated furniture device), while automated furniture accessories 24 may be coupled to the control component 12 at any time (e.g., after purchase of the automated furniture item having the control component 12). In other words, in some embodiments, automated furniture accessories 24 may be coupled to the control component 12 of an automated furniture item that was not sold with such accessories.

In embodiments of the present invention, remote device 26 may be used to control one or more automated furniture accessories 24 coupled to a control component 12 of an automated furniture item. For example, an automated furniture accessory 24, such as an electric heating blanket, may be plugged in to the CAN bus 16 of the control component 12. Upon connection with the CAN bus 16, items of information regarding the particular automated furniture accessory 24 plugged into the CAN bus 16 may be transmitted to the control component 12. Such items of information may include the identity of the automated furniture accessory 24, its manufacturer, a particular type of device (such as a type of heating blanket), general identifying information, placeholders, and other types of information that are identifiable by the control component 12. In some embodiments, items of identifying information may be retrieved from the automated furniture accessory 24 by the control component 12, by virtue of the connection via CAN bus 16.

Having received identifying information regarding the particular automated furniture accessory 24 plugged in to the CAN bus 16, control component 12 may then transmit one or more packets of information to the remote device 26, such as a remote control, according to a communication protocol. The remote device 26 receives the items of information over a wireless connection between the control component 12 and the remote device 26, utilizing the wireless communication device 14. In embodiments, the packets of information communicated between control component 12 and remote device 26 identify the particular automated furniture accessory 24 according to a protocol for communication between the control component 12 and the remote device 26. In further embodiments, control component 12 acts as a 2-way wireless/CAN bridge such that an automated furniture accessory 24 (e.g., an inexpensive CAN accessory) can receive direct commands from the remote device 26.

Figure 2:
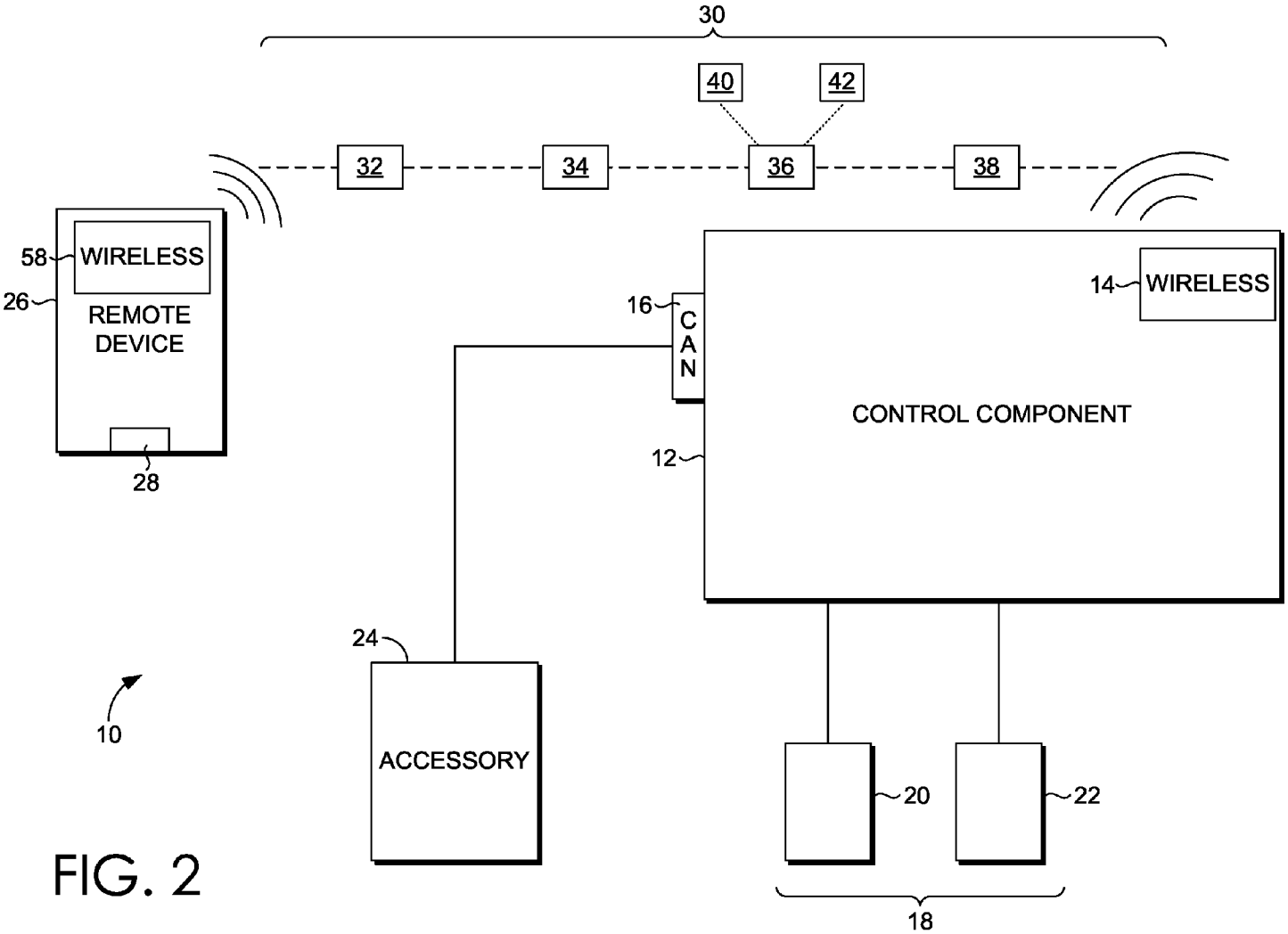
FIG. 2 is the system of FIG. 1 for integrating automated furniture accessories with automated furniture items, including a plurality of packets of a communication protocol, in accordance with an embodiment of the invention.

In another example, a communication protocol may specify particular packets of information that are required to be received by the remote device 26 before the remote device 26 can remotely direct the operation of the automated furniture accessory 24. Referring now to FIG. 2, packets of information 30 may be transmitted between control component 12 and remote device 26 using wireless communication device 14. Such exemplary packets may include a header packet 32, a message ID packet 34, message content packet 36, and a device ID packet 38. As will be understood, the type and number of packets transmitted as part of the communication protocol may vary, and any number of packets may be communicated between the control component 12 and the automated furniture accessory 24.

In one embodiment, header packet 32 provides information that identifies items such as a type of sender of a packet, a type of intended receiver of the packet, a message type, and the like. For example, header packet 32 may identify a control component 12 as the sender of a packet of data according to a communication protocol. In another embodiment, message ID packet 34 provides information regarding a CAN bus and/or MiWi wireless communication device 14 involved in a transmission according to a communication protocol. For example, a message ID packet 34 may identify CAN bus 16 as being involved with the transmission according to a communication protocol. As such, the header packet 32 and/or the message ID packet 34 provide identifying information regarding the sender and receiver of a message, and the type of message that will be transmitted using one or more devices.

In further embodiments, a message content packet 36 provides the content of a message transmitted according to a communication protocol. For example, a message content packet 36 may include instructions to manipulate one or more automated furniture accessories 24 coupled to the CAN bus 16 of a control component 12. As such, in some embodiments, message content packet 36 may include status data 40 and/or command data 42. In embodiments, status data 40 provides a status of one or more devices coupled to the control component 12. For example, status data 40 may indicate, as part of a message content packet 36, whether an automated furniture accessory 24 (such as a heating blanket) is turned to a highest power. Similarly, command data 42 may indicate, as part of a message content packet 36, a particular command directed at one or more devices coupled to the control component 12. For example, command data 42 may indicate, as part of a message content packet 36, a direction to manipulate one or more features of an automated furniture accessory 24 coupled to the control component 12, such as directing the lowering of temperature on a heating blanket.

In yet another embodiment, exemplary packets of information 30 may include a device ID packet 38 that specifically identifies one or more items of hardware coupled to the control component 12. For example, device ID packet 38 may indicate a particular type of automated furniture accessory 24 for control by the remote device 26. Accordingly, any number of device ID packets 38 may be transmitted between control component 12 and remote device 26.

In some embodiments, a communication protocol for controlling one or more automated furniture accessories 24 coupled to the control component 12 may include the transmission of one or more packets of information 30 between the control component 12 and the remote device 26. As such, in some embodiments, a control component 12 may determine one or more packets of information 30 to transmit to remote device 26. The determined one or more packets of information 30 may then enable the remote device 26 to control one or more automated furniture accessories 24 coupled to the control component 12, by virtue of the wireless connection between the remote device 26 and the control component 12.

In some embodiments, an automated furniture accessory 24 may be associated with one or more items of updateable information that may be changed after a user has initially coupled the particular automated furniture accessory 24 to the control component 12. In other words, after a remote device 26 has been configured to control a particular automated furniture accessory 24, one or more updates may become available for the automated furniture accessory 24. Accordingly, in some embodiments, the firmware of remote device 26 may be updated using data port 28. Data port 28 may be any feature associated with the remote device 26 that is capable of receiving data, such as a USB port. In one example, an updated feature of the automated furniture accessory 24 may be communicated to the control component 12 based on inputting the new and/or updated information into data port 28, such as plugging in a USB device containing such updated information.

In a further embodiment, a new and/or updated automated furniture accessory 24 may be coupled to the control component 12. In one embodiment, the control component 12 may be unable to recognize the newly-added automated furniture accessory 24. For example, the control component 12 may have been manufactured without the ability to recognize and/or process particular commands associated with the new and/or updated automated furniture accessory 24. In another example, the control component 12 may be unable to determine one or more items of information to communicate according to the communication protocol, in order to delegate control of the automated furniture accessory 24 to the remote device 26. As such, one or more updates may be provided to the remote device 26 via data port 28, and communicated from the remote device 26 to the control component 12 using wireless communication device 14. Accordingly, the remote device 26 may receive updates via data port 28, communicate such updates to the control component 12, and enable the control component 12 to exchange communication with the remote device 26 regarding the control of the automated furniture accessory 24.

Figure 3:
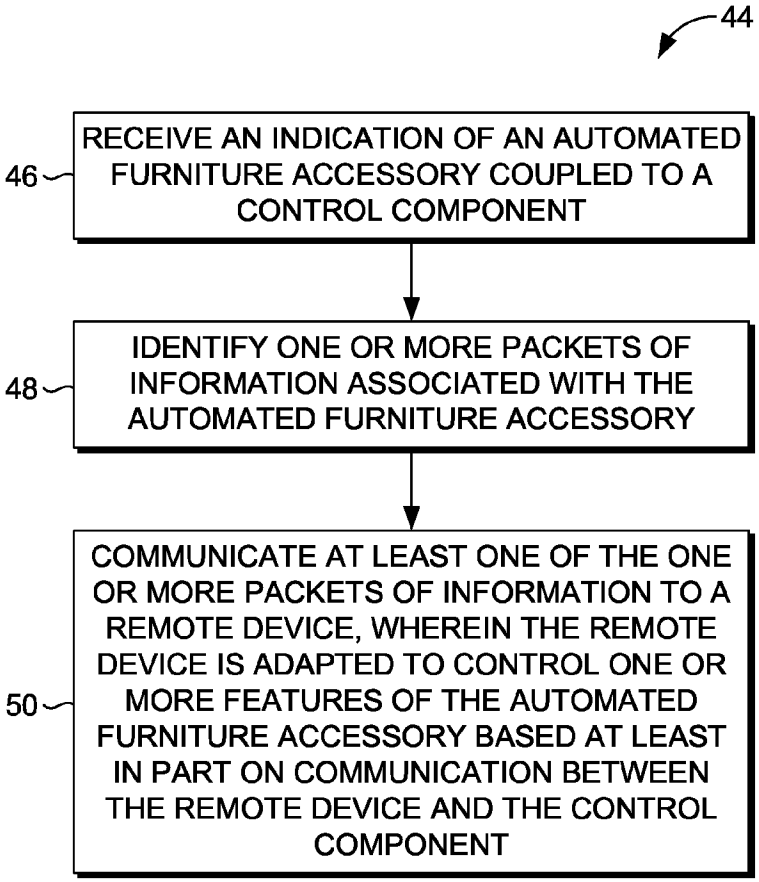
FIG. 3 is a flow diagram of a method for integrating automated furniture accessories with automated furniture items, in accordance with an embodiment of the invention.

Referring next to FIG. 3, an exemplary flow diagram 44 of a method for integrating automated furniture accessories with automated furniture items is provided. At block 46, an indication of an automated furniture accessory coupled to a control component is received. For example, such an indication may be received based on plugging an automated furniture accessory 24 into a CAN bus 16. At block 48, one or more packets of information associated with the automated furniture accessory are identified. As discussed above, in some embodiments, a control component 12 may identify one or more items and/or packets of information 30 according to a communication protocol for control of the automated furniture accessory 24 by a remote device 26. As such, at block 50, at least one of the one or more packets of information is communicated to a remote device that is then adapted to control one or more features of the automated furniture accessory based on the communication between the remote device and the control component. For example, having received one or more packets of information 30 from the control component 12, the remote device 26 may control one or more features of the automated furniture accessory 24.

Figure 4:
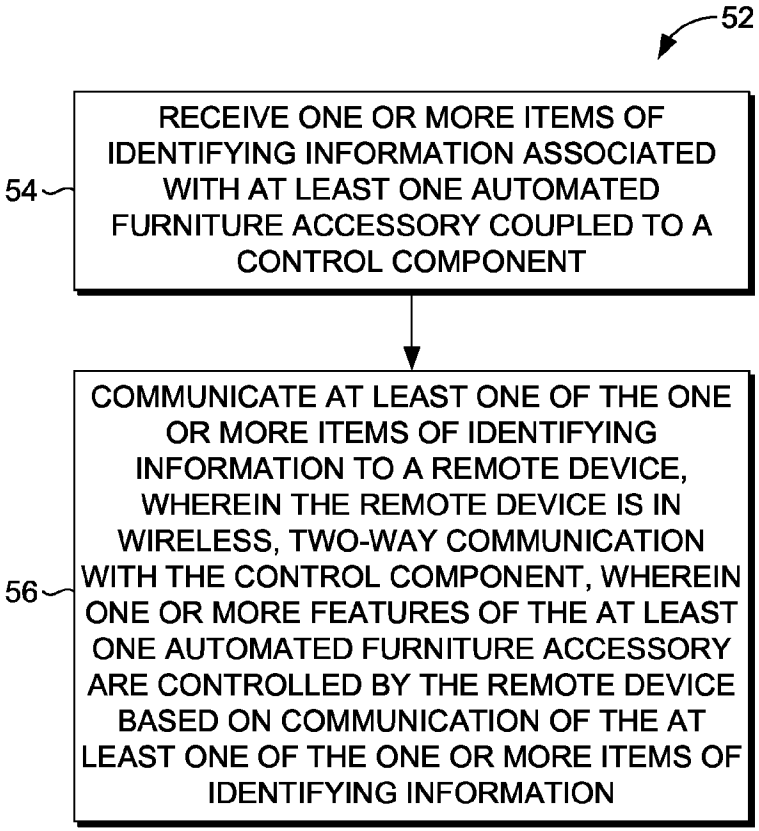
FIG. 4 is a flow diagram of a method for integrating automated furniture accessories with automated furniture items, in accordance with an embodiment of the invention.

Turning now to FIG. 4, a flow diagram 52 of a method for integrating automated furniture accessories with automated furniture items is provided. At block 54, one or more items of identifying information associated with at least one automated furniture accessory coupled to a control component are received. For example, a control component 12 may receive items of identifying information (e.g., a device type or a manufacturer) associated with a particular automated furniture accessory 24. At block 56, at least one of the one or more items of identifying information is communicated to a remote device, with the remote device being in wireless, two-way communication with the control component, and one or more features of the at least one automated furniture accessory being controlled by the remote device based on communication of the at least one of the one or more items of identifying information. Accordingly, in one embodiment, features of an automated furniture accessory 24 may be controlled by the remote device 26 based on communication between the remote device 26 and the control component 12. In other words, by virtue of the direct connection of the automated furniture accessory 24 to the CAN bus 16 of the control component 12, as well as the wireless connection between the remote device 26 and the wireless communication device 14 of control component 12, the remote device 26 may control one or more features of the automated furniture accessory 24.

Figure 5:
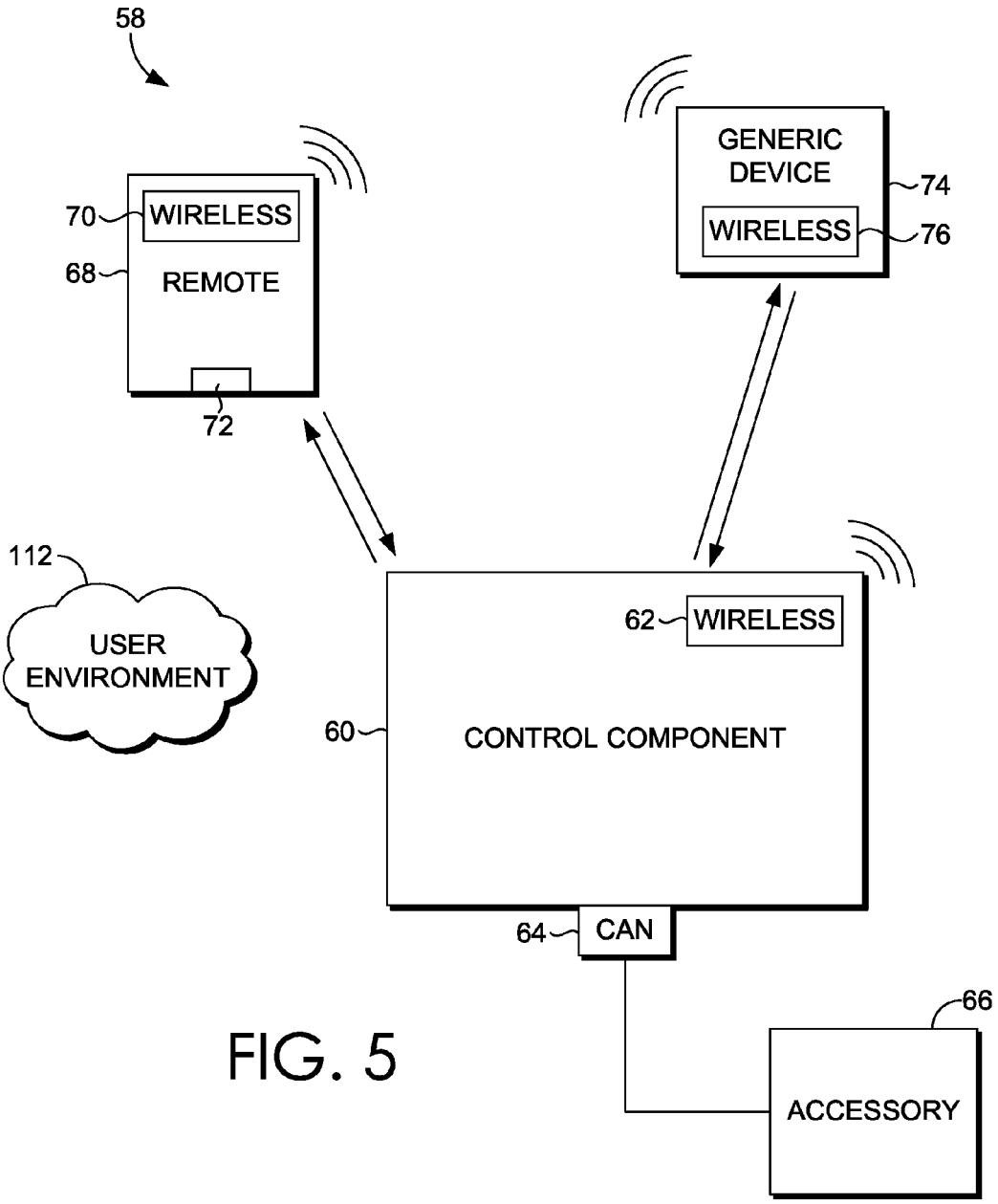
FIG. 5 is a system for integrating generic devices with automated furniture items, in accordance with an embodiment of the invention.

An embodiment of a system 58 for integrating automated furniture accessories and generic devices with automated furniture items is seen in FIG. 5. In the embodiment of FIG. 5, the system 58 generally includes a control component 60 having a wireless communication device 62, a controller area network (CAN) bus 64, and an automated furniture accessory 66 coupled to the CAN bus 64 of the control component 60. Further, the control component 60 is depicted as being in wireless communication with a remote device 68 having a wireless communication device 70 and a data port 72. In one embodiment, control component 60 controls various features of a user environment based on commands received by the control component 60. For example, the control component 60 may control generic device 74, having a wireless communication device 76 configured to communicate with the wireless communication device 62 of control component 60. As used herein, a generic device 74 refers to an external device configured to wirelessly couple to a control component of an automated furniture item. In one embodiment, a generic device refers to one or more devices used to establish a feature of a selected user environment, such as a lighting element, heating element, sound element, and/or other user environment device. Additionally, although a single, exemplary generic device 74 is shown in FIG. 5, it should be understood that any number or combination of generic devices 74 may be coupled to the control component 60.

In some embodiments, the control component 60 includes a processor and a memory capable of receiving and processing commands that are identifiable using the firmware of the control component 60. For example, the control component 60 may receive a command to operate one or more generic devices 74 in wireless communication with the automated furniture item coupled to control component 60. In one embodiment, the remote device 68 is a Accordingly, a remote device 68 may receive an input command from a user, which the remote device 68 transmits, wirelessly, to the wireless communication device 62 of control component 60, using wireless communication device 70. The command may relate to one or more generic devices 74 in wireless communication with (i.e., wirelessly coupled to) the control component 60, such as a command to control a generic device external to the control component 60. In embodiments, remote device 68 is a wireless, handheld device, such as a remote controller, smartphone, and/or tablet device configured to communicate with the control component 60 using a wireless connection. In one embodiment, the remote device 68 is configured to communicate one or more commands to the control component 60, while in further embodiments, the remote device 68 provides an indication of presence to the control component 60. For example, in one embodiment, remote device 68 may be configured to provide an indication of proximity of a user of the remote device 68 to the control component 60 of an automated furniture item. In one embodiment, a proximity profile of a wireless remote device 68, such as a smartphone and/or tablet device, may provide an occupancy indication of a user of an automated furniture item.

In embodiments, wireless communication device 62 may be used in the transmission of wireless commands to and from the control component 60. As such, wireless communication device 62 may be any wireless communication device used to transmit wireless communication to and from one or more remote devices 68 that communicate wirelessly with the control component 60. For example, the wireless communication device 62 may be a wireless device that executes a two-way communication protocol, such as a MiWi and/or Zigbee protocol. In further embodiments, wireless communication device 62 communicates using 2.4 GHz protocols, including 2.4 GHz side bands or 2.4 GHz stacks. Additionally, in one example, wireless communication device 62 may execute a RF4CE protocol. In some embodiments, wireless communication device 62 is used to communicate wirelessly between the control component 60 and the remote device 68, which may also be referred to as a remote control.

In addition to communicating via wireless communication device 62, the control component 60 may also interact with external devices that are coupled to the control component 60, such as the automated furniture accessory 66 coupled to the CAN bus 64 of the control component 60. In embodiments, CAN bus 64 may directly or indirectly couple one or more automated furniture accessories 66 to control component 60. In one example, an automated furniture accessory 66 may be directly coupled to the control component 60 (e.g., distributed with the control component 60 upon manufacture of the automated furniture device), while in further embodiments, an automated furniture accessory 66 may be coupled to the control component 60 at any time (e.g., after purchase of the automated furniture item having the control component 60). In other words, in some embodiments, an automated furniture accessory 66 may be coupled to the control component 60 of an automated furniture item that was not sold with such accessories. In embodiments of the present invention, remote device 68 may be used to control one or more automated furniture accessories 66 coupled to a control component 60 of an automated furniture item. Accordingly, remote device 68 may be used to wirelessly control an automated furniture accessory 66 coupled to control component 60 based on a command communicated from wireless communication device 70 to wireless communication device 62.

In further embodiments, remote device 68 may be used to indirectly control one or more generic devices 74 wirelessly coupled to the control component 60. Accordingly, in some embodiments, a wireless communication protocol utilized between the wireless communication device 70 and the wireless communication device 62 may correspond to a wireless communication protocol utilized between the wireless communication device 62 and the wireless communication device 76. In one embodiment, packets of information communicated from remote device 68 to control component 60 (i.e., between wireless communication device 70 and wireless communication device 62, respectively), may identify a particular generic device 74 as an intended recipient device of the packets of information. For example, a command received from a user of the remote device 68 may provide instructions to the control component 60 to activate a particular feature of a user environment 112, such as dimming lights. Accordingly, a light fixture associated with generic device 74 may receive a command transmitted from wireless communication device 62 to wireless communication device 76. In other words, control component 60 serves as a central repository for commands related to the user environment 112, by virtue of the common wireless communication protocol utilized between the remote device 68, the control component 60, and the generic device 74.

In another example, a wireless communication protocol may specify particular packets of information communicated between the remote device 68 and the control component 60, and between one or more generic devices 74 and the control component 60. As discussed above with reference to FIG. 2, exemplary packets of information may be transmitted between a control component and a remote device, which may include a header packet, a message ID packet, message content packet, and a device ID packet. As will be understood, the type and number of packets transmitted as part of the wireless communication protocol may vary, and any number of packets may be communicated between the remote device 68 and the control component 60, and control component 60 and the generic device 74.

In one embodiment, a header packet provides information that identifies items such as a type of sender of a packet, a type of intended receiver of the packet, a message type, and the like. For example, a header packet may identify a control component 60 as the sender of a packet of data according to a wireless communication protocol. In another embodiment, a message ID packet may provide information regarding a CAN bus and/or MiWi wireless communication device involved in a transmission according to a communication protocol. For example, a message ID packet may identify CAN bus 64 as being involved with the transmission according to a communication protocol. As such, the header packet and/or the message ID packet provides identifying information regarding the sender and receiver of a message, and the type of message that will be transmitted using one or more devices.

In further embodiments, a message content packet provides the content of a message transmitted according to a wireless communication protocol. For example, a message content packet may include instructions to manipulate one or more generic devices 74 coupled to the control component 60 based on wireless communication between the wireless communication device 62 and the wireless communication device 76. As such, in some embodiments, a message content packet may include status data and/or command data. In embodiments, status data provides a status of one or more devices coupled to the control component 60. For example, status data may indicate, as part of a message content packet, whether a generic device 74 is turned on, and to what level of power it is currently set. Similarly, command data may indicate, as part of a message content packet, a particular command directed at one or more generic devices 74 coupled to the control component 60.

In yet another embodiment, exemplary packets of information may include a device ID packet that specifically identifies one or more items of hardware coupled to the control component 60. For example, a device ID packet may indicate a particular type of automated furniture accessory 66 for control by the remote device 68 (via control component 60). Accordingly, any number of device ID packets may be transmitted between control component 60 and remote device 68. In further embodiments, a device ID packet may indicate a particular type of generic device 74 for control by the remote device 68 (via control component 60).

In some embodiments, a communication protocol for controlling one or more generic devices 74 coupled to the control component 60 may include the transmission of one or more packets of information between the control component 60 and the remote device 68, and one or more packets of information between the control component 60 and the generic device 74. As such, in some embodiments, a control component 60 may determine one or more packets of information to transmit to remote device 68. The determined one or more packets of information may then enable the remote device 68 to indirectly control one or more generic devices 74 wirelessly coupled to the control component 60, by virtue of the wireless connection between the wireless communication devices 70, 62, and 76.

In some embodiments, generic device 74 may be associated with one or more items of updateable information that may be changed after a user has initially, wirelessly coupled the particular generic device 74 to the control component 60. In other words, after a remote device 68 has been configured to control a particular generic device 74 via the control component 60, one or more updates may become available for the generic device 74. Accordingly, in some embodiments, the firmware of remote device 68 may be updated using data port 72. Data port 72 may be any feature associated with the remote device 68 that is capable of receiving data, such as a USB port. In one example, an updated feature of the generic device 74 may be communicated to the control component 60 based on inputting the new and/or updated information into data port 72, such as plugging in a USB device containing such updated information.

In a further embodiment, a new and/or updated generic device 74 may be coupled to the control component 60. In one embodiment, the control component 60 may be unable to recognize the newly-added generic device 74. As such, one or more updates may be provided to the remote device 68 via data port 72, and communicated from the remote device 68 to the control component 60 using wireless communication devices 70 and 62. Accordingly, the remote device 68 may receive updates via data port 72, communicate such updates to the control component 60, and enable the control component 60 to exchange communication with the remote device 68 regarding the control of the generic device 74.

Figure 6:
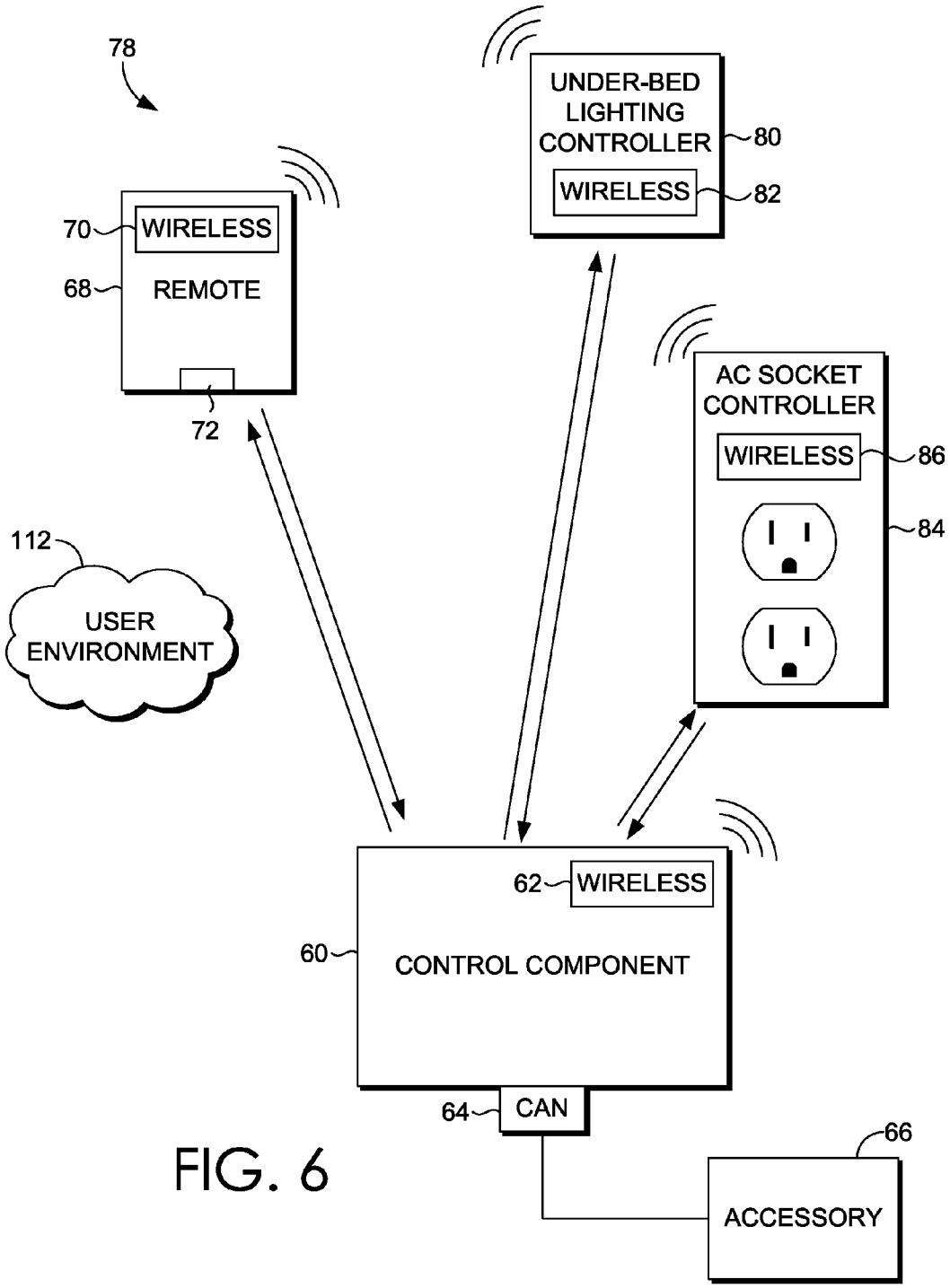
FIG. 6 is a system for integrating generic devices with automated furniture items, in accordance with an embodiment of the invention.

With reference to FIG. 6, an embodiment of a system 58 for integrating automated furniture accessories and generic devices with automated furniture items is shown. In the embodiment of FIG. 5, the system 78 generally includes a control component 60 having a wireless communication device 62, a controller area network (CAN) bus 64, and an automated furniture accessory 66 coupled to the CAN bus 64 of the control component 60. Further, the control component 60 is depicted as being in wireless communication with a remote device 68 having a wireless communication device 70 and a data port 72. In one embodiment, control component 60 controls various features of a user environment based on commands received by the control component 60. For example, the control component 60 may control multiple types of generic devices having wireless communication devices configured to communicate with the wireless communication device 62 of control component 60. In the exemplary embodiment of FIG. 6, the control component 60 is coupled to an under-bed lighting controller 80, having a wireless communication device 82, and an AC socket controller 84, having a wireless communication device 86. Although the control component is coupled to two "generic" devices (the under-bed lighting controller 80 and the AC socket controller 84) in FIG. 6, it should be understood that any number or combination of generic devices may be wirelessly coupled to the control component 60.

In one embodiment, a control component 60 may be used to establish a particular user environment 112, having one or more customizable features that satisfy one or more requests from a user of an automated furniture item. For example, the user of the automated furniture item coupled to control component 60 may provide an indication to the remote device 68 that the user selects a particular user environment setting, such as an evening setting from a set of "favorites" environment profiles. Upon selection of the particular user environment setting, the remote device 68 may communicate a set of commands to the control component 60 for distribution (by the control component 60) to one or more generic devices 74 coupled to the control component 60. As such, a single indication to the remote device 68 may trigger a series of commands to be executed by the various generic devices 74 coupled to the control component 60. In a further embodiment, in response to a single indication of a particular user environment (received by the remote device 68 and communicated to the control component 60), control component 60 determines a set of commands corresponding to the received user environment selection. In one embodiment, a set of commands corresponding to a selected user environment may include both commands for execution by a control component 60 and commands for execution by one or more generic devices coupled to the control component 60. For example, a control component 60 may be directly coupled to the motor of an automated bed, and wirelessly coupled to an external lighting fixture (i.e., a generic device). As such, a set of commands received by the control component 60 may be directed to an intended "recipient" of such commands based on the communication between the remote device 68, the control component 60, and one or more generic devices 74.

In another embodiment, a control component 60 may be used to establish a particular user environment 112 based on receipt of an indication of occupancy received by the control component 60 coupled to an automated furniture item.

For example, an occupancy detection system may be coupled to the control component 60, such as the capacitive occupancy detection system and/or method described in one or more of the following: U.S. Nonprovisional patent application Ser. No. 13/346,386, entitled "Capacitive Wire Sensing for Furniture," filed Jan. 9, 2012; U.S. Nonprovisional patent application Ser. No. 13/749,120, entitled "Capacitive Wire Sensing for Furniture," filed Jan. 24, 2013; and U.S. Nonprovisional patent application Ser. No. 13/854,720, entitled "Occupancy Detection for Furniture," filed Apr. 1, 2013, the contents of all three of which is hereby incorporated by reference in its entirety. As such, a presence-sensing technology (e.g., a system coupled to and/or integrated with the control component 60, and/or method of presence-sensing performed by the control component 60 and/or additional components coupled to the control component 60) may be used to detect the presence or absence of a user of an automated furniture item. As such, a presence-sensing technology may be used to detect the presence or absence of a user of an automated furniture item. Based on such presence detection, the control component 60 may then direct the corresponding commands to generate a desired user environment 112 based on a previously-determined set of commands corresponding to a particular user environment setting. In embodiments, the commands corresponding to a particular user environment setting may be communicated from the control component 60 to one or more generic devices 74, such as an under-bed lighting controller 80 and/or AC socket controller 84.

For example, a control component 60 of an automated furniture item, such as a bed, may receive a command from a user via the remote device 68 to select an "evening" user environment setting. In response to the command input into the remote device 68, and communicated from the wireless communication device 70 to the wireless communication device 62 of the control component 60, the control component 60 may direct commands corresponding to one or more generic devices 74. For example, the control component 60 may deliver commands corresponding to one or more settings and/or energy levels of one or more generic devices 74. For example, to establish the "evening" user environment setting selected by a user of the remote device 68, the control component 60 may direct the under-bed lighting controller 80 to provide dimmed light, while the AC socket controller 84 may be directed to turn on a device plugged into the socket, such as a particular lamp. Accordingly, a subsequent indication of user presence received by the control component 60 may cause one or more changes to the settings established as part of the "evening" user environment setting. In some embodiments, based on the indication of the user's presence (e.g., detected using presence-sensing technology such as a capacitive wire sensing technology integrated into the automated furniture item), a predetermined set of commands corresponding to a particular "evening" favorites and/or user environment setting may be executed by the control component 60. As such, the control component 60 may deliver the corresponding commands to individual, generic devices 74 according to the detected change in presence sensing and its relation to the particular room settings. In embodiments, based on the wireless communication protocol between the control component 60 and the individual, generic devices 74, one or more features of the user environment 112 may be changed in response to commands received from the control component 60. In one example, a user's presence may be detected on an automated bed, after which the control component 60 coupled to the automated bed directs the under-bed lighting controller 80 to turn off the under-bed lights, and similarly, directs the AC socket controller 84 to turn off a lamp coupled to the AC socket controller 84. In another example, a user may temporarily exit the bed, at which time the control component 60 may direct the under-bed lighting controller 80 to illuminate, while the control component 60 need not also activate the AC socket controller 84. Accordingly, in response to a presence detection, a corresponding change in one or more features of a user environment may be triggered by a command received from the control component 60.

Figure 7:
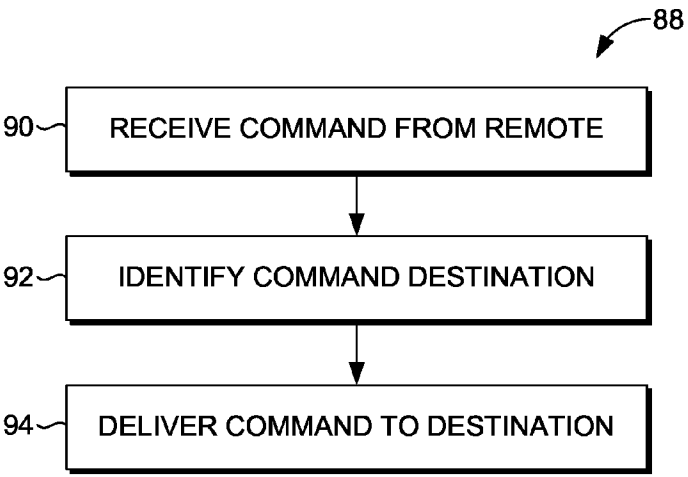
FIG. 7 is a flow diagram of a method for integrating generic devices with automated furniture items, in accordance with an embodiment of the invention.

Referring next to FIG. 7, an exemplary flow diagram 88 for integrating generic devices with an automated furniture item is provided. At block 90, a command is received from a remote device. In embodiments, the received command may include a received selection of a particular user environment, while in other embodiments, the received command may correspond directly to a particular generic device coupled to the control component. At block 92, a command destination is identified for the received command. For example, a received command including a selection of a particular user environment may include multiple commands for delivery to multiple generic devices coupled to a control component. In another embodiment, the received command may relate directly to a particular generic device, for which the control component determines the command's destination (i.e., determines to send the command received from the remote device to the intended recipient—the particular generic device). As such, at block 94, a command is delivered to its destination.

Figure 8:
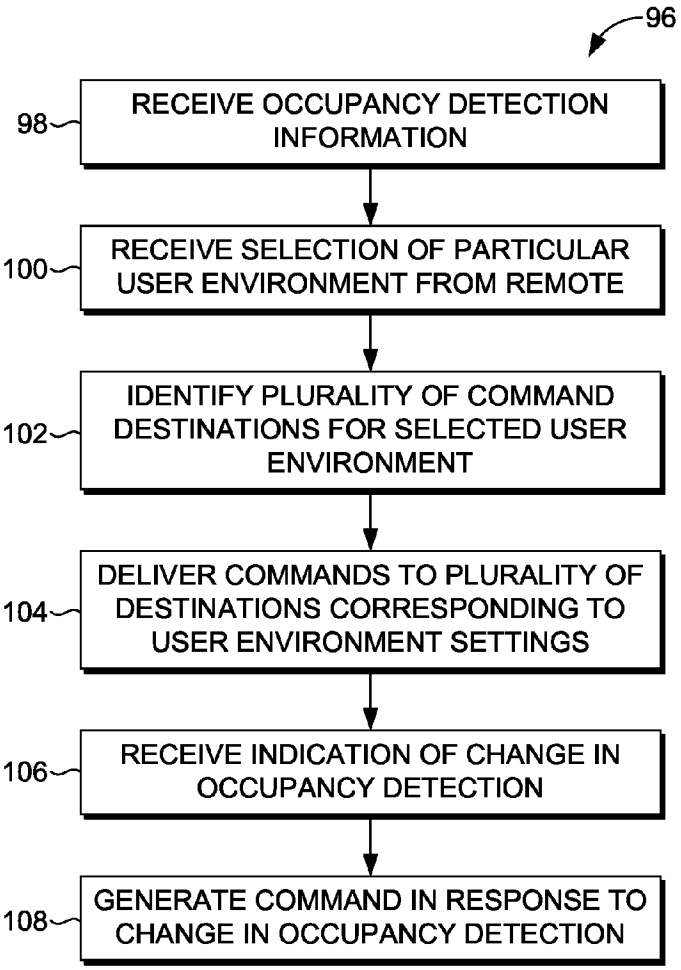
FIG. 8 is a flow diagram of a method for integrating generic devices with automated furniture items, in accordance with an embodiment of the invention.

Turning now to FIG. 8, a flow diagram 96 of a method for integrating generic devices with automated furniture items is provided. At block 98, occupancy detection information is received. At block 100, a selection of a particular user environment is received from the remote device. As such, at block 102, a plurality of command destinations are identified from the selected user environment. For example, a plurality of generic devices may correspond to the settings of a particular user environment, such as a generic device for lighting, a generic device for sound, etc. At block 104, the commands corresponding to the user environment settings are delivered (e.g., primary commands) to the plurality of destinations (e.g., multiple generic devices used to create the selected user environment and/or commands directed to the control component). Accordingly, at block 106, a subsequent change in occupancy detection is received by the control component of the automated furniture item, which indicates a change in occupancy since the initial occupancy determination was received. In response to the received change in occupancy, at block 108, a command(s) (e.g., secondary command(s)) is delivered to a destination, such as a subsequent command delivered to a particular generic device. For example, a user environment may be established having dimmed lights and light music. Upon an occupant exiting the automated furniture item, a command directing the lighting to increase in intensity may be delivered to a generic device, such as a lamp coupled to a wireless AC socket controller.

From the foregoing, it will be seen that this invention is one well adapted to attain all the ends and objects hereinabove set forth together with other advantages, which are obvious and inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. A system for integrating one or more generic devices with an automated furniture item comprising:

a first generic device comprising a first wireless communication device, wherein the first generic device is an automated furniture accessory; and a control component associated with the automated furniture item, wherein:

the control component comprises a control area network bus communicatively coupled to the first generic device, the control component comprises a second wireless communication device, the control component is configured to generate and communicate one or more packets of information corresponding to the first generic device, the control component is configured to receive a first command for controlling one or more features of the first generic device, the control component is configured to detect an indication of occupancy of the automated furniture item, and the control component is configured to generate and communicate a second command for controlling the one or more features of the first generic device, wherein the second command is generated based at least in part on the indication of occupancy; and a remote device wirelessly coupled to the control component, said remote device comprising a third wireless communication device, wherein the remote device is configured to:

receive the one or more packets of information corresponding to the first generic device, and generate and communicate the first command for controlling the one or more features of the first generic device.

2. The system of claim 1, wherein the remote device is configured to wirelessly control the first generic device based on wirelessly coupling the first generic device to the control component.

3. The system of claim 2, wherein the remote device is configured to wirelessly control the first generic device based at least in part on communication between the control component and the remote device.

4. The system of claim 1, wherein each of the first, second, and third wireless communication devices is a two-way communication device that facilitates two-way communication.

5. The system of claim 1, wherein the system further comprises a second generic device coupled to the control component, said second generic device comprising a fourth wireless communication device, wherein the remote device is configured to wirelessly control the second generic device based on wirelessly coupling the second generic device to the control component.

6. The system of claim 5, wherein the control component is configured to generate and communicate a third command for controlling one or more features of the second generic device, wherein the third command is generated based at least in part on the indication of occupancy.

7. The system of claim 1, wherein the remote device is wirelessly coupled to the control component, and further wherein the remote device is adapted to receive information from and transmit information to the control component using the third wireless communication device.

8. The system of claim 7, wherein the remote device comprises updateable firmware adapted to receive information regarding a generic device coupled to the control component.

9. The system of claim 7, wherein the remote device comprises a screen comprising one or more control indicators, wherein the one or more control indicators are updated based on receiving information regarding one or more generic devices coupled to the control component.

10. A method for integrating generic devices with automated furniture items, the method comprising:

receiving, by a control component of an automated furniture item, an indication of at least one generic device wirelessly coupled to the control component, wherein the at least one generic device is external to the control component, and wherein the first generic device is an automated furniture accessory;

generating and communicating, by the control component, one or more packets of information corresponding to the at least one generic device to a remote device wirelessly coupled to the control component;

receiving a first command from the remote device, wherein the first command corresponds to one or more features of the at least one generic device;

wirelessly communicating the received first command from the control component to the at least one generic device;

receiving an indication of occupancy associated with the automated furniture item;

based at least in part on the received indication of occupancy, determining a second command corresponding to a feature of the at least one generic device; and wirelessly communicating the determined second command from the control component to the at least one generic device.

11. The method of claim 10, wherein the method further comprises wirelessly communicating a status indication to the remote device, wherein the status indication comprises an indication of the at least one generic device coupled to the remote device.

12. The method of claim 10, wherein the first command comprises a particular user environment selection.

13. The method of claim 12, wherein the particular user environment selection comprises a selection of a set of commands corresponding to a plurality of features associated with the at least one generic devices coupled to the control component, wherein upon selection of the particular user environment, the set of commands are communicated to the at least one generic devices.

14. The method of claim 12, wherein the second command wirelessly communicated from the control component to the at least one generic device corresponds to both the particular user environment selection and the received occupancy indication.

15. A method for establishing a particular user environment corresponding to occupancy detection for an automated furniture item coupled to at least one generic device, the method comprising:

generating and communicating, by a control component, one or more packets of information corresponding to at least one generic device to a remote device wirelessly coupled to the control component;

receiving an indication of a particular user environment selection from the remote device, the particular user environment selection comprising a set of commands corresponding to settings of the particular user environment for the at least one generic device coupled to a control component of the automated furniture item;

communicating at least one primary command corresponding to the received user environment selection from the control component to the at least one generic device wirelessly coupled to the control component;

receiving an indication of a change in occupancy detection associated with the automated furniture item;

determining at least one secondary command based at least in part on:

(1) the set of commands for the at least one generic device; and (2) the received change in occupancy detection; and communicating the at least one secondary command to the at least one generic device coupled to the control component.

16. The method of claim 15, wherein the particular user environment selection further comprises one or more settings corresponding to one or more hard-wired features of the automated furniture item.

17. The method of claim 15, wherein the remote device comprises a screen comprising one or more control indicators, wherein the one or more control indicators are updated to provide one or more control indicators corresponding to the at least one generic device.

18. The method of claim 15, wherein the remote device comprises a screen comprising one or more control indicators, wherein the one or more control indicators are updated to provide one or more control indicators corresponding to a plurality of user environment selection options.

19. The method of claim 15, wherein communicating at least one secondary command to the at least one generic device coupled to the control component comprises communicating at least one command corresponding to at least one of the plurality of settings.

20. The method of claim 15, wherein the wireless, two-way communication between the remote device, the control component, and the at least one generic device is one or more of a MiWi and a Zigbee communication.

* * * * *